US008341807B2

(12) United States Patent
Conzelmann et al.

(10) Patent No.: US 8,341,807 B2
(45) Date of Patent: Jan. 1, 2013

(54) MOUNTING DEVICE FOR PRODUCING AN ALL-STEEL CARD CLOTHING

(75) Inventors: Rene Conzelmann, Burladingen (DE); Benjamin Beck, Bitz (DE); Carmen Sautter, Balingen (DE)

(73) Assignee: Groz-Beckert KG, Albstadt (DE)

( * ) Notice: Subject to any disclaimer, the term of this patent is extended or adjusted under 35 U.S.C. 154(b) by 67 days.

(21) Appl. No.: 12/965,108

(22) Filed: Dec. 10, 2010

(65) Prior Publication Data

US 2011/0138580 A1 Jun. 16, 2011

(30) Foreign Application Priority Data

Dec. 16, 2009 (EP) ..... 09015526

(51) Int. Cl.
*D01G 15/92* (2006.01)

(52) U.S. Cl. ..... 19/114

(58) Field of Classification Search ..... 19/114; D15/78; 140/97
See application file for complete search history.

(56) References Cited

U.S. PATENT DOCUMENTS

| | | | | |
|---|---|---|---|---|
| 2,000,070 | A * | 5/1935 | Flynn | 140/97 |
| 2,384,650 | A | 9/1945 | Sjogren | |
| 4,643,367 | A | 2/1987 | Waters et al. | |
| 7,360,735 | B2 * | 4/2008 | Schneider et al. | 242/419.4 |
| 7,395,581 | B2 | 7/2008 | Hösel et al. | |
| 7,673,374 | B2 | 3/2010 | Hösel | |
| 2004/0056137 | A1 * | 3/2004 | Bocht et al. | 242/416 |
| 2011/0139291 | A1 | 6/2011 | Bruske et al. | |

FOREIGN PATENT DOCUMENTS

| | | |
|---|---|---|
| CH | 255376 | 6/1948 |
| DE | 10061286 | 4/2002 |
| DE | 102004004433 | 8/2005 |
| DE | 102004055310 | 5/2006 |
| EP | 1399901 | 3/2004 |
| GB | 564214 | 9/1944 |
| WO | 0246505 | 6/2002 |
| WO | 2004035886 | 4/2004 |

* cited by examiner

*Primary Examiner* — Shaun R Hurley
(74) *Attorney, Agent, or Firm* — Fitch, Even, Tabin & Flannery, LLP

(57) ABSTRACT

A mounting device 12 for producing all-steel card clothings 2 with improved mounting quality. The mounting device 12 comprises a guide arrangement 28 for guiding the profile wire 3. The guide arrangement 28 may comprise, for example, an angle adjustment arrangement 32 comprising two brake jaws 30, 31. The mounting device 12 has at least one longitudinal axis 34, 45, about which the guide arrangement 28 can be pivoted. The guide arrangement 28 can be pivoted manually, with the use of a motor or by spring force. In addition, the guide arrangement 28 and the angle adjustment arrangement 32, respectively, can be adjusted in linear direction, and horizontally and vertically in a direction transverse to the longitudinal direction of the profile wire 38. Optionally, the guide arrangement 28 may replace a separate brake arrangement as well as a separate alignment arrangement.

19 Claims, 3 Drawing Sheets

MOUNTING DEVICE FOR PRODUCING AN ALL-STEEL CARD CLOTHING

CROSS-REFERENCE TO RELATED APPLICATION

The present application claims the priority of European Patent Application No. 09 015 526.8, filed Dec. 16, 2009, the subject matter of which, in its entirety, is incorporated herein by reference.

BACKGROUND OF THE INVENTION

The invention relates to an all-steel mounting device for producing an all-steel card clothing for a carding drum or a carding element of a carding machine.

In textile technology, a carding machine or carder (briefly: card or teasel) is used to separate, order, for example to render homogeneous and/or parallel, fibers or fiber material such as, for example, wool, cotton or the like. The product of a carding process is a fibrous web. This fibrous web consist of a loose assembly of ordered individual fibers that can be used to create a non-woven or formed fabric. The fibrous web is obtained in that the fibers are removed with the use of removing means from a large carding drum also referred to as a tambour, and then combined.

In most cases, the carding machine comprises a number of different carding drums or rollers, each being provided with outward-pointing sharp barbs or teeth. Depending on the purpose of use, the number of sharp tips per unit area varies. Likewise, the form and alignment of the tips may vary.

At least one of the mentioned carding drums, for example the tambour, is provided with an all-steel card clothing. Said card clothing consists of a profile wire having a sawtooth profile that has been wound, under tension, onto the carding drum. The profile wire has a foot and a blade. For example, the foot has a rectangular cross-section with two flanks that are parallel to each other and has a back abutting against the surface of the cylindrical carding drum. On the radially outer side, the blade is provided with a sawtooth profile, for example. The profile wire that is arranged overall on a helical line is preferably subject to longitudinal tension. Its ends are securely attached to the drum, for example, by soldering, welding or in another manner.

One requirement for card clothings, in particular as relates to all-steel card clothings, is the longest possible useful life. In addition, it is endeavored that the profile wire installed on the carding drum, the all-steel clothing, can be subsequently re-sharpened. Other requirements for all-steel card clothing are minimal damage to the fibers and optimal fiber resolution, optimal homogenization and/or optimal parallel alignment of the fibers at the time of the production of the fiber fleece.

For mounting all-steel clothing, mounting devices are used. For example, such a mounting device has been known from document EP 1 399 901 B1. The carding drum that is provided with a profile wire is set in a rack and is driven in a prespecified direction of rotation. In doing so, a profile wire is supplied in a controlled manner so that the profile wire is wound on the carding drum at a defined tension. The start and the end of the profile wire are affixed to the carding drum by soldering. In addition, it may be necessary to weld the ends of the profile wires to each other in a blunt manner, for example, when a carding drum requires more profile wire than is held by a feed spool.

Documents DE 10 2004 004 433 A1 and DE 10 2004 055 310 A1 disclose a rotational speed controller and control device, for example a measuring device for mounting profile wires on carding drums in carding machines, without removing the affected carding drums from the carding machine.

Fundamentally, a mounting device comprises each a braking and a guide arrangement that guides the profile wire pulled off a feed spool and creates the required bias. The braking and guide arrangement is frequently designed as a carriage that can be slid in longitudinal direction of the carding drum.

Usually, the profile wire is arranged so as to lie on the feed spool, whereby the individual layers are separated by anti-corrosive paper. In doing so, the expression "lying arrangement" is understood to mean that the profile wire is arranged so as to lie flat on one of its flanks. Thus, the teeth of the profile wire essentially point in axial direction of the feed spool. When mounting the profile wire, the profile wire is rotated about 90 degrees about its longitudinal axis, so that said wire can be wound upright onto the carding drum and the sawtooth profile points approximately in radial direction.

One great challenge when mounting a profile wire to produce an all-steel card clothing is to prevent the all-steel card clothing from tilting or tipping over on the already loaded portion of the carding drum. As a rule, the mounted profile wire tends to tip the all-steel card clothing in the direction in which the drum has already been wound with profile wire. Under certain process conditions, the profile wire will also tip in the direction of the carding drum that has not yet been loaded with wire.

In order to obtain a homogenized fiber fleece it is absolutely necessary that the surface of a carding drum be uniformly fitted with a profile wire. The center plane or the alignment plane of a profile wire that has been optimally mounted on a carding roller is perpendicular to a plane that extends through the longitudinal axis of the carding drum. Carding drums, sections thereof or regions on their surface that have been damaged or are fitted with tilted profile wire cannot be used. Therefore, it is necessary that any tilted profile wire on the carding drum be unwound again. Inasmuch as the mounting operation of a profile wire on a carding drum represents a highly complex process that is influenced by the adjustment of many parameters of the mounting device, a tilted profile wire is discarded, as a rule, because the profile wire is plastically deformed during the mounting operation. This deformation, in turn, affects the mounting parameters in such a manner that a mounting process that is both safe and economical is possible only under more difficult conditions. Consequently, a once tilted profile wire is unwound and discarded.

It is the object of the invention to provide an all-steel card clothing that, in a simple manner, allows mounting of a profile wire in order to produce an all-steel wire clothing with high quality and high process safety.

SUMMARY OF THE INVENTION

The above object generally is achieved with the all-steel mounting device in accordance with the invention and with the method in accordance with the invention.

The mounting device in accordance with the invention comprises a guide arrangement that is disposed to guide the profile wire in order to produce an all-steel card clothing on the carding drum. The guide arrangement communicates with an angle-adjustment arrangement in order to allow the angular alignment of the profile wire.

The method in accordance with the invention makes it possible to affect the profile wire during the mounting operation in such a manner that said wire will not display any torque when the all-steel card clothing is being produced, said torque being the reason for tilting said wire. Consequently, the all-steel card clothing can be produced in a simple manner and displaying high quality. In particular, the tilting tendencies of the profile wire are suppressed, these tilting tendencies otherwise potentially resulting in a tilting of the individual convolutions of the all-steel card clothing. The otherwise typical defect when mounting the all-steel card clothing, i.e., the tilting or tipping over of said clothing on the already loaded portion of the carding drum is thus prevented. The alignment plane of an optimally mounted profile wire is perpendicular to a plane through the longitudinal direction of the carding drum. Due to the angle adjustment arrangement in accordance with the invention, a potentially existing twist of the profile wire can be compensated for in that the profile wire is fed to the carding drum in a slightly inclined manner. Optionally, the profile wire may be fed twisted in the positive or negative direction relative to a plane through the carding drum, i.e., with respect to the optimal perpendicular position of said wire (alignment plane).

In particular, it is expedient for the guide arrangement to comprise a freely rotatable angle adjustment arrangement having an output orifice. In doing so, the rotational axis of the output orifice preferably corresponds to the longitudinal axis of the profile wire. The longitudinal axis of the profile wire corresponds to the wire advance direction of the profile wire. It is also possible for the angle adjustment arrangement to be rotatably supported transversely to the longitudinal direction of the profile wire, i.e., in addition to the rotational axis. Furthermore, it is possible to adjust the angle adjustment arrangement in a linear direction in addition to the rotary adjustment options. To accomplish this, said angle adjustment arrangement comprises guide means or clamping means that allow an adjustment in transverse direction, i.e., horizontally and/or vertically with respect to the longitudinal direction of the profile wire. These multiple adjustment options enable the mounting of the profile wire to be mounted on carding drums with different diameters, without additional tangential deflection.

Preferably, the guide arrangement also comprises a braking arrangement for decelerating the passage of the profile wire. In doing so, the profile wire may be kept at a controlled tension when being mounted on the carding drum so that the all-steel card clothing is seated on the carding drum at a desired preliminary tension.

In addition, the guide arrangement may comprise two pressure jaws that can be biased relative to each other in order to clamp the profile wire between them. In doing so, the pressure jaws act as brake jaws, said jaws preferably acting on the flanks of the profile wire. In this manner, the profile wire can be decelerated during the mounting operation and, in addition, the profile wire may be reliably provided with the desired angular alignment. In particular, said profile wire may be rotated in such a manner that it is wound with a counter twist on the carding drum.

Preferably, the pressure jaws of the braking arrangement are arranged on a common carrier that is arranged so as to be adjustable relative to the remaining mounting device. In doing so, the angular adjustment arrangement allows the adjustment of a pivoting angle or angle of rotation of the carrier relative to the remaining mounting device.

Preferably, the angle adjustment arrangement is configured so that it can be locked in place. For example, a locking screw or the like may be provided for locking. However, it is also possible to provide an actuating drive, for example, a self-inhibiting actuating drive such as, for example, a worm drive. Said drive may be disposed so as to be adjustable by manual actuation or, in a motorized manner, by means of a motor.

The angle adjustment arrangement, in particular its support can be adjusted by spring force or be held in the selected angular position. To accomplish this, said arrangement comprises at least two spring means acting in opposite direction, said spring means being tension springs or helical springs. Depending on the ratio of the spring constant of these two springs, the angle adjustment arrangement can be set up in one angle. This angle can then be varied by changing the tendency of the profile wire to rotate—as far as is allowed by the spring force of the spring means.

In addition to the guide arrangement, the mounting device may comprise an alignment arrangement comprising several alignment rollers, the profile wire passing between said alignment rollers. Starting from the feed spool, the profile wire preferably first moves through the alignment arrangement and subsequently through the guide arrangement comprising the angle adjustment arrangement in order to then be wound on the carding drum.

The angle adjustment arrangement in accordance with the invention may be an integral component of the guide arrangement or the mounting device. Considering the inventive adjustment of the profile wire, it is not necessary that a separate device separate from the guide arrangement or the mounting device be made available. All the functions required for the mounting operation such as, for example, alignment, braking and twisting the profile wire and other functions, can be implemented in one device.

The mounting device may be part of a mounting machine that accommodates the feed spool as well as the carding drum provided with the all-steel card clothing. The machine frame of this mounting machine positions the feed spool, the carding drum and the mounting device relative to each other and takes over the rotating drive of the carding drum. However, it is also possible to configure the mounting device in such a manner that it delivers the profile wire to a carding drum inside the carding machine. In this case, the mounting device comprises a rack that can be permanently installed in the machine frame or be arranged relative to the machine frame. Independent of the setup of the mounting device inside its own mounting machine or inside the carding machine, the mounting device is preferably arranged on a carriage that can be axially moved toward the carding drum provided with the all-steel clothing in order to be able to gradually wind the profile wire on the entire circumference of said drum along the entire axial extension of said drum.

Additional details of advantageous embodiments of the invention result from the drawings, the description or claims. The description is restricted to essential aspects of the invention and miscellaneous situations. The drawings disclose additional details. Therefore, they should be used as a supplementary reference.

DETAILED DESCRIPTION OF THE INVENTION

The description of the exemplary embodiments of an angle adjustment arrangement in accordance with the invention is based on a mounting process by which the profile wire is mounted, without gaps, on the all-steel card clothing. Also, instances of application have been known, these requiring that a distance be provided between the lateral surfaces of the mounted profile wire. The advantages of an angle adjustment arrangement in accordance with the invention are useful with gap-free mounting, as well as in the case the profile wire is mounted with gaps on a carding drum.

Figure 1:
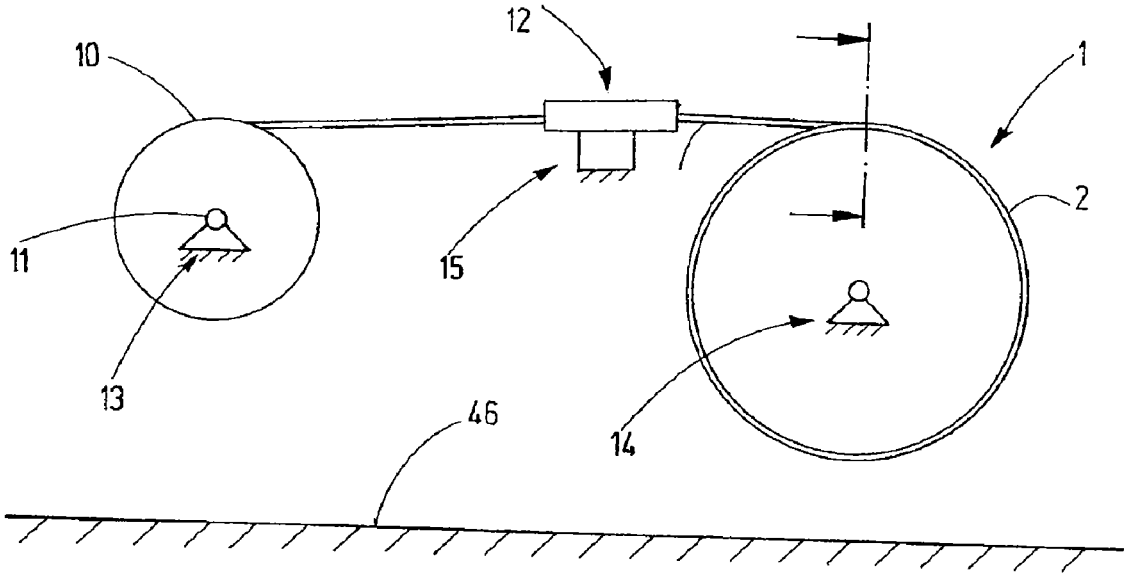
FIG. 1 is a schematic lateral view of a feed spool, a carding drum and a mounting device.
Figure 2:
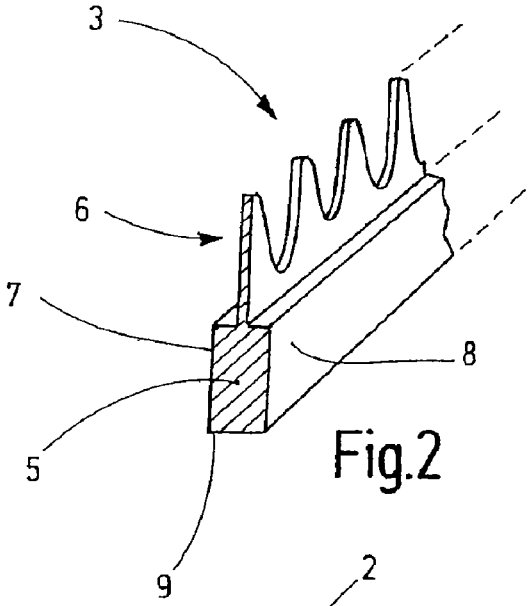
FIG. 2 is a perspective view of a detail of the profile wire for the production of an all-steel card clothing.
Figure 3:
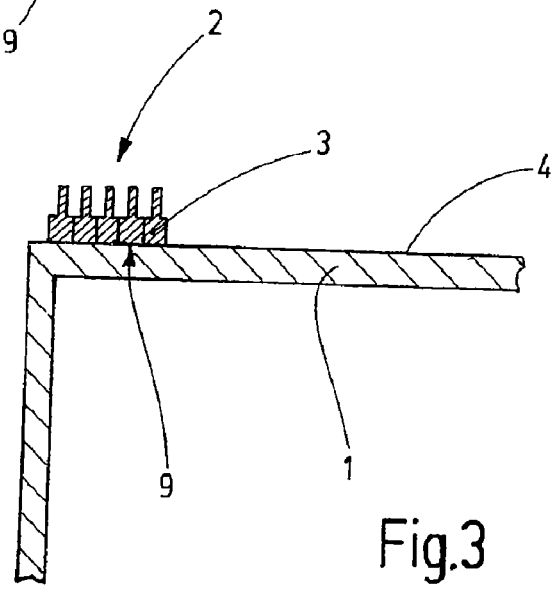
FIG. 3 is a view of a detail of a radial section of a carding drum with an all-steel card clothing.

FIG. 1 shows a carding drum for carding textile material, for example in a carding machine. To do so, the carding drum 1 is provided with an all-steel card clothing 2. The card clothing consists, for example, of a profile wire 3 wound in a gapless manner on the generated surface of the carding drum 1, said profile wire abutting against the generated surface 4 of the carding drum 1 with appropriate longitudinal pull, as indicated in FIG. 3. Consequently, the profile wire 3 follows a helical line. As is shown by FIG. 2, said wire usually has a foot section 5, said section, for example having a rectangular cross-section, and a blade section 6 extending radially outward away from the foot section. The blade section 6 is toothed, for example, so that it may have a sawtooth profile. Preferably, the blade section 6 is narrower than the foot section 5. The foot section 5 is delimited by two preferably planar flanks 7, 8 and by a back that is located on the side facing away from the blade section 6. When the profile wire 3 is mounted on the carding drum 1 and thus an all-steel card clothing has been produced, the individual convolutions of the profile wire 3—when wound in a gapless manner—abut against each other flank to flank. The back 9 is lies on the generated surface 4.

Figure 4:
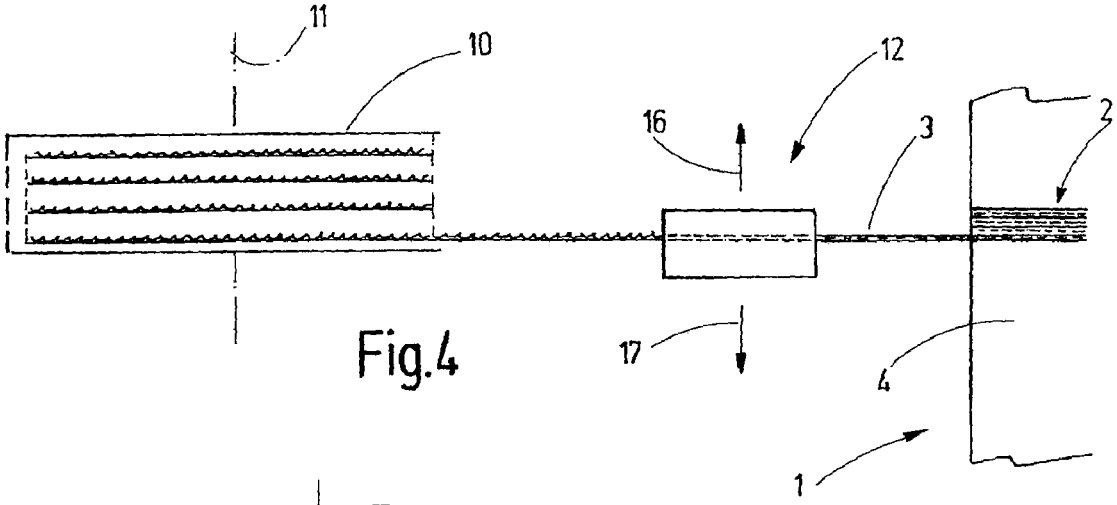
FIG. 4 is a schematized plan view of the feed spool, the mounting device and the carding drum in accordance with FIG. 1.

In order to fit the carding drum 1 with the profile wire 3, i.e., produce the all-steel clothing 2, the profile wire 3, as is obvious from FIGS. 1 and 4, must be pulled off a feed spool 10 and, if at all possible, wound onto the carding drum 1 under controlled preliminary tension. The profile wire 3 is wound lying on the feed spool 10. The flanks 7, 8 of the profile wire are oriented at a right angle relative to the radial direction. The teeth and the blade section 6, respectively, point in axial direction of the feed spool 10 that is rotatably supported about a rotational axis 11.

In order to produce the all-steel card clothing 2 the profile wire 3 must be guided—relative to the axial direction of the carding drum 1—in axial direction in such a manner that the profile wire 3 lies—without gaps—convolution next to convolution. In addition, the profile wire 3 must be kept at a controlled preliminary tension. In addition, it must be twisted, i.e., by at least 90 degrees about its longitudinal axis, so as to be upright. The preliminary twist with which the profile wire was provided on the feed spool 11 must be taken into consideration during the mounting process. While the profile wire 3 on the feed spool 10 is wound on one of its flanks 7 or 8, said wire is wound on the carding drum 1 so that the wire's back 9 is lying on the generated surface 4. The mounting device 12 is provided to achieve the aforementioned objects when the profile wire 3 is being guided.

The mounting device 12 may be part of a mounting machine that comprises the support 13 of the feed spool 10 as well as the support 14 of the carding drum 1, and the support 15 of the mounting device. The supports 13 through 14 may provided on one and the same machine frame, said machine frame being seated on the floor 46 and being stationarily arranged relative to said floor. This stationary association is illustrated by shaded areas in FIG. 1. However, the stationary association can also be achieved inside a carding machine that already contains the support 14 for the carding drum 1. A rack that must be temporarily installed in or on the carding machine then becomes the support 15 of the mounting device 12 and, optionally if desired, also the support of the feed spool 10. In each of the mentioned cases, the support 15 performs the lateral and/or axial adjustment of the mounting device 12, said adjustments needing to be carried out consistent with the advance of the mounting operation. The adjustment is illustrated by arrows 16, 17 in FIG. 4. The associate adjustment device that moves the mounting device 12 in synchrony with the rotation of the carding drum 1 is not shown.

Figure 6:
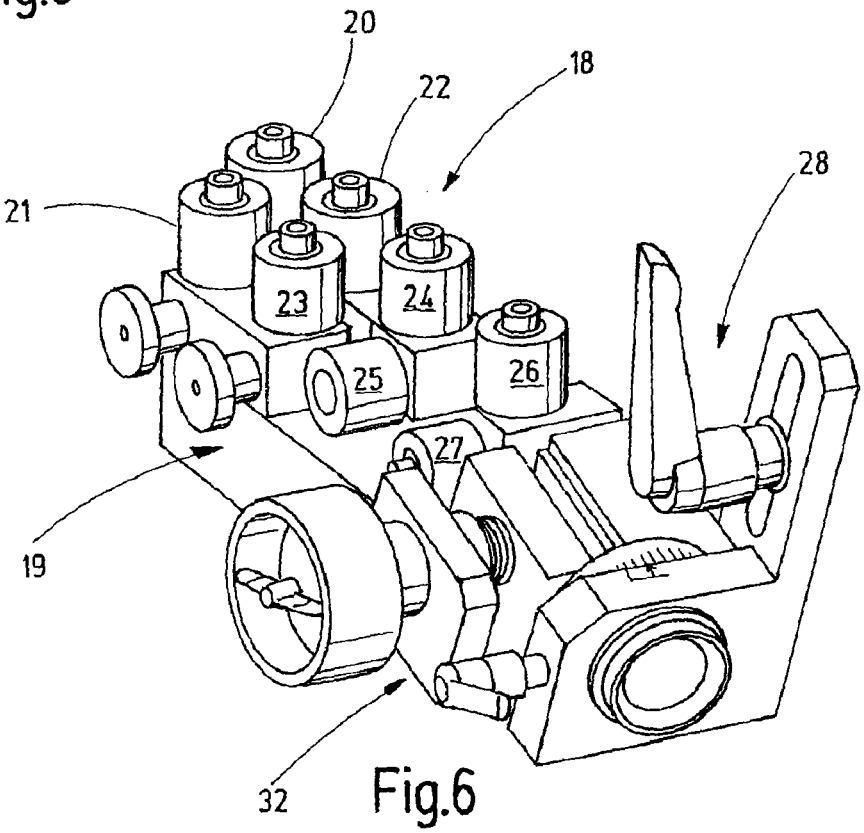
FIG. 6 is a schematized perspective representation of a detail of a part of the mounting device in accordance with FIGS. 1 and 4.
Figure 7:
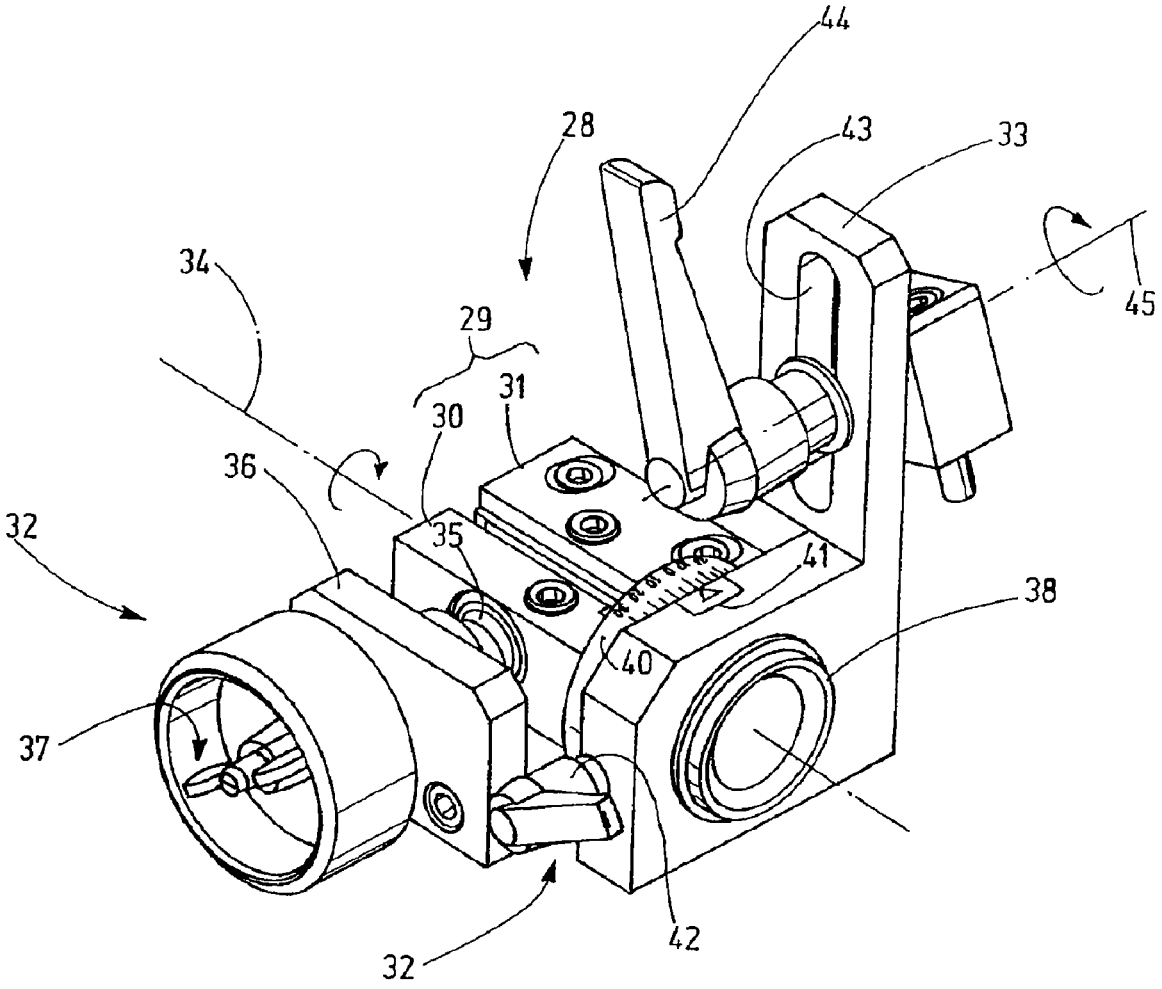
FIG. 7 is a separate perspective representation of the angle adjustment arrangement of the mounting device.

A mounting device 12 as shown in FIG. 6 comprises at least one alignment arrangement 18 that is disposed to erect the profile wire 3 coming from the feed spool 10. To accomplish this, the alignment arrangement 18 comprises several alignment rollers 20, 21, 22, 23, 24 mounted to a rack 19 as well as, optionally, additional guide rollers 25, 26, 27. The alignment rollers 21 through 24 act on the flanks 7, 8 of the profile wire 3 when said wire passes between the alignment rollers 21 through 24. The alignment arrangement 18 is followed by a guide arrangement 28 that may comprise a braking arrangement 29, for example two brake jaws 30, 31 (FIG. 7).

In the present exemplary embodiment, the guide arrangement 28 is supported by an angle adjustment arrangement 32. Said angle adjustment arrangements enables a rotation of the guide arrangement 28 relative to the alignment arrangement 18 and relative to a holder 33—said holder being stationary with respect to said alignment arrangement—about a longitudinal axis 34. The longitudinal axis 34 is oriented so as to be parallel to the profile wire 3 or so as to be aligned alongside said profile wire. Preferably, the profile wire 3 moves along the longitudinal axis 34.

The two brake jaws 30, 31 are disposed to clamp the profile wire 3 between them. To do so, at least one of the bake jaws in the present exemplary embodiment of the brake jaws 30 is supported so as to be movable toward the brake jaw 31 and away therefrom. By means of a spring 35, the brake jaw 30 is biased toward the break jaw 31. One end of the spring 35 abuts against the brake jaw 30 and the other end of said spring abuts against a counter bearing 36 that is part of a carrier rack. This carrier rack can be rotated about the longitudinal axis 34 relative to the holder 33 by means of the angle adjustment arrangement 32. For tensioning or relaxing the spring 35, a manual adjustment device 37 is provided, which device may be arranged on the outside of the rack or the counter bearing 36. The angle adjustment arrangement 32 comprises a bushing 38, for example, said bushing extending through the holder 33. In so doing, the bushing 38 forms a swivel bearing concentric to the longitudinal axis 34. The carrier of the brake arrangement 29 may have an indicator scale 40 that communicates with an indicator 41 or another marking. The indicator 41 may be rigidly affixed to the holder 33.

Furthermore, a clamping device 42 is disposed to clamp the angle adjustment arrangement 32 in place. The clamping device 42 may be, for example, a hand screw or another means. Alternatively, the relative rotation of the angle adjustment arrangement 32 may also be embodied by a worm in engagement with teeth, or by similar means. The relative rotation may be achieved manually as well as with the use of a servomotor.

It is possible to rotate the angle adjustment arrangement 32 transversely with respect to the longitudinal axis of the profile wire 3 in addition to the rotation about the longitudinal axis 34. To accomplish this, the angle adjustment arrangement 32 comprises the clamping means 44 and the guide means 43. After releasing the clamping means 44, the entire angle adjustment arrangement can be rotated transversely to the longitudinal direction of the profile wire 3 about the longitudinal axis 45. Furthermore, the clamping means 44 and the guide means 43, said guide means being configured as a guide pin guided in a longitudinal guide, enable the vertical, linear adjustment of the angle adjustment arrangement 32 in transverse direction relative to the longitudinal direction of the profile wire 3. Additionally, it is possible for the entire angular adjustment arrangement 32 to be arranged on a linear guide (not illustrated), said linear guide enabling the horizontal, linear adjustment in transverse direction relative to the longitudinal direction of the profile wire 3.

Figure 5:
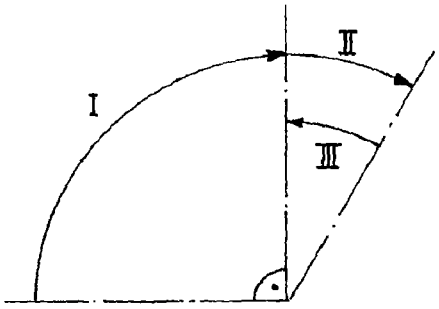
FIG. 5 is a schematized representation of the longitudinal torsion relationships on the profile wire upstream and downstream of the mounting device.

The all-steel card clothing is mounted on the carding drum 1 as follows:

First, the profile wire 3 is guided through the mounting device 12 while being twisted by 90 degrees, so that the teeth of the profile 3 are essentially oriented in radial direction relative to the carding drum 2. Then, one end of the profile wire 3 is attached to the carding drum 1 and the rotation of the carding roller 1 is gradually started up. In doing so, the profile wire 3 moves through the mounting device 12. The wire passes the alignment rollers 20 through 24, where it is being straightened. On its path between the feed spool 10 and the mounting device 12, the wire is already being twisted by 90 degrees. Consequently, said wire is being moved out of its lying state as shown in FIG. 4, left side, into its erect state. Then the profile wire 3 moves through the guide arrangement 28 that may be rotated relative to the alignment arrangement 18 about the longitudinal axis 34. As is shown by FIG. 5, the profile wire is thus rotated, during a first step I, from the feed spool 10 to the alignment arrangement 18 by 90 degrees and then, in a second step II, by the guide arrangement 28 by another angular value about the longitudinal axis 34. In doing so, the profile wire 3 is guided in a decelerated manner between the brake jaws 30, 31, said brake jaws imparting said wire with the desired rotation in accordance with step II.

The profile wire that moves freely through the bushing 38 displays a certain rebound capability. Therefore, in step III, said wire—due to its rebound properties—twists back downstream of the bushing 38, as a result of which said wire is now twisted by approximately 90 degrees relative to its original position. Consequently, the profile wire III may move onto the generated surface 4 of the carding drum 1, and the back 9 of said wire may lie in a planar manner on said generated surface. An inclined position or tilting of the profile wire 3 is effectively prevented. With the use of the mentioned measure, it is possible to apply even particularly narrow or even particularly high profile wires in a safe manner during the production of the all-steel card clothing. In addition, the production of all-steel card clothings is possible, wherein the individual convolutions of the profile 3 maintain a distance from each other.

The present invention relates to a mounting device 12 for producing all-steel card clothings 2 with improved mounting quality. The mounting device 12 comprises a guide arrangement 28 for guiding the profile wire 3. The guide arrangement 28 may comprise, for example, an angle adjustment arrangement 32 comprising two brake jaws 30, 31. The mounting device 12 has at least one longitudinal axis 34, 45, about which the guide arrangement 28 can be pivoted. The guide arrangement 28 can be pivoted manually, with the use of a motor or by spring force. In addition, the guide arrangement 28 and the angle adjustment arrangement 32, respectively, can be adjusted in linear direction, and horizontally and vertically in a direction transverse to the longitudinal direction of the profile wire 38. Optionally, the guide arrangement 28 may replace a separate brake arrangement as well as a separate alignment arrangement.

It will be appreciated that the above description of the present invention is susceptible to various modifications, changes and modifications, and the same are intended to be comprehended within the meaning and range of equivalents of the appended claims.

LIST OF REFERENCE NUMERALS

1 Carding drum
2 All-steel card clothing
3 Profile wire
4 Generated surface
5 Foot section
6 Blade section
7, 8 Flanks
9 Back
10 Feed spool
11 Rotational axis
12 Mounting device
13-15 Support
16, 17 Arrows
18 Alignment arrangement
19 Rack
20-24 Alignment rollers
25-27 Guide rollers
28 Guide arrangement
29 Braking arrangement
30, 31 Brake jaws
32 Angle adjustment arrangement
33 Holder
34 Longitudinal axis, wire advance direction
35 Spring
36 Counter bearing
37 Manual adjustment device
38 Bushing
40 Indicator scale
41 Indicator
42 Clamping device
43 Guide means
44 Clamping means
45 Longitudinal axis
46 Floor

What is claimed is:

1. Mounting device for all-steel card clothing, comprising a guide arrangement (28) that is disposed to guide the profile wire (3) along a wire advance direction (34) onto the carding drum (1), wherein the guide arrangement (28) comprises an angle adjustment arrangement (32) for setting an angular alignment of the profile wire (3) of the all-steel card clothing (2), wherein the angle adjustment arrangement (32) is configured so as to be adjustable, and the angle adjustment arrangement (32) is supported so as to be rotatable about the wire advance direction (34).

2. Mounting device as in claim 1, characterized in that the angle adjustment arrangement (32) is supported so as to be rotatable about the longitudinal axis (45).

3. Mounting device as in claim 1, characterized in that the angle adjustment arrangement (32) is supported so as to be adjustable in linear direction.

4. Mounting device as in claim 1, characterized in that the angle adjustment arrangement (32) comprises a clamping arrangement (44) and a guide arrangement (43), said guide arrangement allowing an adjustment transversely with respect to the longitudinal plane (34) in vertical direction.

5. Mounting device as in claim 3, characterized in that the angle adjustment arrangement (32) is supported so as to be adjustable transversely to the longitudinal plane (34) in horizontal direction.

6. Mounting device as in claim 1, characterized in that the guide arrangement (28) comprises a braking arrangement (29) for inhibiting the passage of the profile wire (3).

7. Mounting device as in claim 1, characterized in that the mounting device further comprises a common carrier and brake jaws (30, 31) that are arranged on the common carrier, said carrier being connected to the angle adjustment arrangement (32).

8. Mounting device as in claim 1, characterized in that the angle adjustment arrangement (32) comprises a clamping device (42) for locking in place the selected and the adjusted angle positions.

9. Mounting device as in claim 1, characterized in that an alignment arrangement (18) is arranged between the guide arrangement (28) and the feed spool (10).

10. Mounting device as in claim 9, characterized in that the alignment arrangement (18) comprises several alignment rollers (20-24) between which the profile wire (3) passes.

11. Mounting device as in claim 1, characterized in that the mounting device (12) is connected with a rack, in which case the mounting device (12) can be locked with said rack in a fixed position relative to the carding drum (1).

12. Mounting device as in claim 1, characterized in that the mounting device (12) comprises a support (14) for the accommodation of the carding drum (1).

13. Mounting device as in claim 1, characterized in that the mounting device (12) comprises a support (11) for the accommodation of a feed spool (10).

14. Method for mounting a profile wire (3), said profile wire having two flanks (7, 8) and a back (9) opposite which a blade section (6) having teeth is provided, on a carding drum (1) of a carding machine for producing an all-steel card clothing (2), wherein one of the flanks (7, 8) of the profile wire is provided wound on a feed spool (10), from where the back (9) of the profile wire (3) is wound with the application of tensile stress onto the carding drum (1), and wherein the profile wire (3) is imparted with a twist prior to being wound on the carding drum (1), said twist deviating from the alignment plane of a profile wire (3) that has been mounted on the carding drum (1).

15. Mounting device for all-steel card clothing, comprising a guide arrangement (28) that is disposed to guide the profile wire (3) along a wire advance direction (34) onto the carding drum (1), wherein the guide arrangement (28) comprises an angle adjustment arrangement (32) for setting an angular alignment of the profile wire (3) of the all-steel card clothing (2), wherein the angle adjustment arrangement (32) is configured so as to be adjustable, and wherein:

(i) the angle adjustment arrangement (32) comprises a clamping arrangement (44) and a guide arrangement (43), said guide arrangement allowing an adjustment transversely with respect to the longitudinal plane (34) in vertical direction;

(ii) the guide arrangement (28) comprises a braking arrangement (29) for inhibiting the passage of the profile wire (3);

(iii) the mounting device further comprises a common carrier and brake jaws (30, 31) that are arranged on the common carrier, said carrier being connected to the angle adjustment arrangement (32); or (iv) the angle adjustment arrangement (32) comprises a clamping device (42) for locking in place the selected and the adjusted angle positions.

16. Mounting device as in claim 15, characterized in that the mounting device includes (i) the angle adjustment arrangement (32) comprises a clamping arrangement (44) and a guide arrangement (43), said guide arrangement allowing an adjustment transversely with respect to the longitudinal plane (34) in vertical direction.

17. Mounting device as in claim 15, characterized in that the mounting device includes (ii) the guide arrangement (28) comprises a braking arrangement (29) for inhibiting the passage of the profile wire (3).

18. Mounting device as in claim 15, characterized in that (iii) the mounting device further comprises a common carrier and brake jaws (30, 31) that are arranged on the common carrier, said carrier being connected to the angle adjustment arrangement (32).

19. Mounting device as in claim 15, characterized in that the mounting device includes (iv) the angle adjustment arrangement (32) comprises a clamping device (42) for locking in place the selected and the adjusted angle positions.

* * * * *